US005727646A

United States Patent [19]

Gray

[11] Patent Number: 5,727,646

[45] Date of Patent: Mar. 17, 1998

[54] RETRACTABLE FALL RESTRAINT DEVICE

[76] Inventor: Geoffrey H. Gray, 8101 E. Dartmouth, No. 45, Denver, Colo. 80231

[21] Appl. No.: 512,150

[22] Filed: Aug. 7, 1995

[51] Int. Cl.[6] ..... E04G 1/36

[52] U.S. Cl. ..... 182/45; 182/3; 248/237

[58] Field of Search ..... 182/45, 3, 4; 248/237, 248/228.1, 316.1, 285.1, 286.1

[56] References Cited

U.S. PATENT DOCUMENTS

| | | | |
|---|---|---|---|
| 591,772 | 12/1897 | Matter . | |
| 1,300,040 | 4/1919 | Stuart | 182/4 |
| 2,108,196 | 5/1938 | Davies | 248/323 |
| 2,699,313 | 1/1955 | Tarman | 248/237 |
| 2,877,875 | 3/1959 | Bolt | 248/286.1 |
| 3,217,833 | 11/1965 | Smith | 182/3 |
| 4,249,713 | 2/1981 | Glynn et al. | 248/237 |
| 5,036,949 | 8/1991 | Crocker et al. | 182/3 |
| 5,248,021 | 9/1993 | Nichols | 182/3 |
| 5,282,597 | 2/1994 | Babcock | 248/237 |
| 5,297,651 | 3/1994 | Vandelinde | 182/3 |
| 5,320,193 | 6/1994 | Bongiovanni et al. | 182/3 |
| 5,320,194 | 6/1994 | Bredijk | 182/45 |
| 5,346,036 | 9/1994 | Arisman et al. | 182/3 |
| 5,361,558 | 11/1994 | Thornton et al. | 52/698 |
| 5,370,202 | 12/1994 | Nichols | 182/3 |

FOREIGN PATENT DOCUMENTS 28 47 275 10/1978 Germany .

OTHER PUBLICATIONS

Label from roof anchor device from DBI/SALA, D B Industries, Inc., no page no., no date.

*Primary Examiner*—Ramon O. Ramirez
*Assistant Examiner*—Anita M. King
*Attorney, Agent, or Firm*—Sheridan Ross P.C.

[57] ABSTRACT

A retractable device and method for restraining a fall from a roof or other structure is described. The device has a first extended position to allow the attachment of a lifeline and a second retracted position which conceals the apparatus below the exterior surface of a roof or other structure.

20 Claims, 5 Drawing Sheets

RETRACTABLE FALL RESTRAINT DEVICE

FIELD OF THE INVENTION

The invention is directed to a restraining device, and in particular relates to a retractable restraining device which allows the attachment of a lifeline to minimize injuries to individuals working on a roof or similar elevated structure. The device is secured to the structural components and may easily be reciprocated between a first extended position for actual use and a second retracted position for concealed storage.

BACKGROUND OF THE INVENTION

During the construction of homes, office buildings and other structures, construction workers are often required to work at dangerous heights to install roofing materials, mechanical equipment and other apparatus. Due to the pitch of the roof, awkward working conditions, and high elevations, many construction workers are injured or killed as a result of inadvertent falls.

Due to these numerous injuries, the Office of Safety and Health Administration and other governmental agencies have passed regulations requiring the installation of fall restraint devices on roofs and similar structures. These fall restraint devices are generally metal braces anchored to a structural portion of the roof near the apex, and provide an eyebolt or bracket for attaching a lifeline or rope. The lifeline is attached to a harness or belt worn by the construction worker to arrest a fall if the worker slips or otherwise loses his balance.

There are currently many types of fall restraint devices used in the construction industry. These include permanently anchored brackets with pad eyes extending from the roof, as described in U.S. Pat. Nos. 5,370,202 and 4,249,713. Another type of fall restraint device is an eyebolt which extends through the roof and is secured with a nut on the interior of the roof, as described in U.S. Pat. No. 5,346,036.

However, all of the devices known to the inventor leave portions of the restraint devices permanently exposed on the exterior surface of the roof after construction operations are completed. These exposed restraint members are not only unsightly, but dangerous since unknowing homeowners often use these devices improperly and for lifting or securing heavy objects, often resulting in failure and subsequent injury.

Thus, a need exists to provide a fall restraint device which can be securely anchored to a roof for use during construction, but which can be subsequently and easily removed from the surface of the roof after use. This type of device would help prevent untrained homeowners and others from using the fall restraint devices in non-specified and dangerous applications. Additionally, by utilizing a retractable design, the fall restraint device can be quickly extended outside of the roofing surface from within the attic space at a later date if roofing repairs or other construction operations are required.

SUMMARY OF THE INVENTION

The invention relates to a retractable fall restraint device and a method for its installation and use. The device generally is comprised of an anchoring bracket and an interconnected attachment member, or slide plate. The retractable feature of the invention allows the device to be installed on a structural portion of a roof or other elevated member, used for its intended purpose, and then retracted to prevent unauthorized and dangerous use by homeowners or the untrained.

The present invention provides a fall restraint device which can be attached to a structural component of a roof or other building structure. The device may then be attached to a lifeline and harness worn by a construction worker to prevent a fall from a dangerous height. The lifeline may be attached by a carabiner, bracket or other mechanism which can be quickly attached and removed.

The present invention further provides a fall restraint device which is retractable. That is, the device when in actual use is extended in a position which allows the attachment of a lifeline. Upon completion of the construction project or other use, the device may then be easily and quickly retracted to a concealed storage position.

Similarly, the present invention provides an apparatus and method for installation and use which is fast, safe and efficient to use. That is, the materials and components used in the device are durable and require very little training to use. Thus, construction workers can install the device with common construction hardware and materials and safely use the apparatus for its intended purpose.

The present invention provides a device which will allow the attachment of one lifeline or a plurality of lifelines, depending on the required application. This may be accomplished by increasing the strength of the components of the device, and/or allowing for a plurality of restraint members.

These and other objects and advantages will become readily apparent from the following detailed description of the invention and from the drawings.

BRIEF DESCRIPTION OF TEE DRAWINGS

DETAILED DESCRIPTION OF THE PREFERRED EMBODIMENT

In accordance with the present invention, a fall restraint device is provided which can be anchored to a structural member to arrest falls taken by those in elevated working conditions. The device generally includes a restraint member (e.g., slide plate or restraint cable) interconnectable to an anchoring bracket, which secures the slide plate to a structural member of a roof or other building component. During use, the slide plate is extended outside an exterior surface of the roof, exposing a device for attaching a lifeline or rope. The lifeline can be attached to a harness or belt worn by a construction worker to arrest falls. Once roofing or any other activity is completed, the slide plate may be easily retracted to a concealed position below the surface of the roof to prevent use by the non-skilled or untrained. If at any time in the future the fall restraint device is needed for subsequent roof repairs or other purposes, the slide plate may easily be extended to its original position of use without attaching or removing any hardware. This sequence of retracting and extending the slide plate can be repeated as frequently as required.

Figure 1:
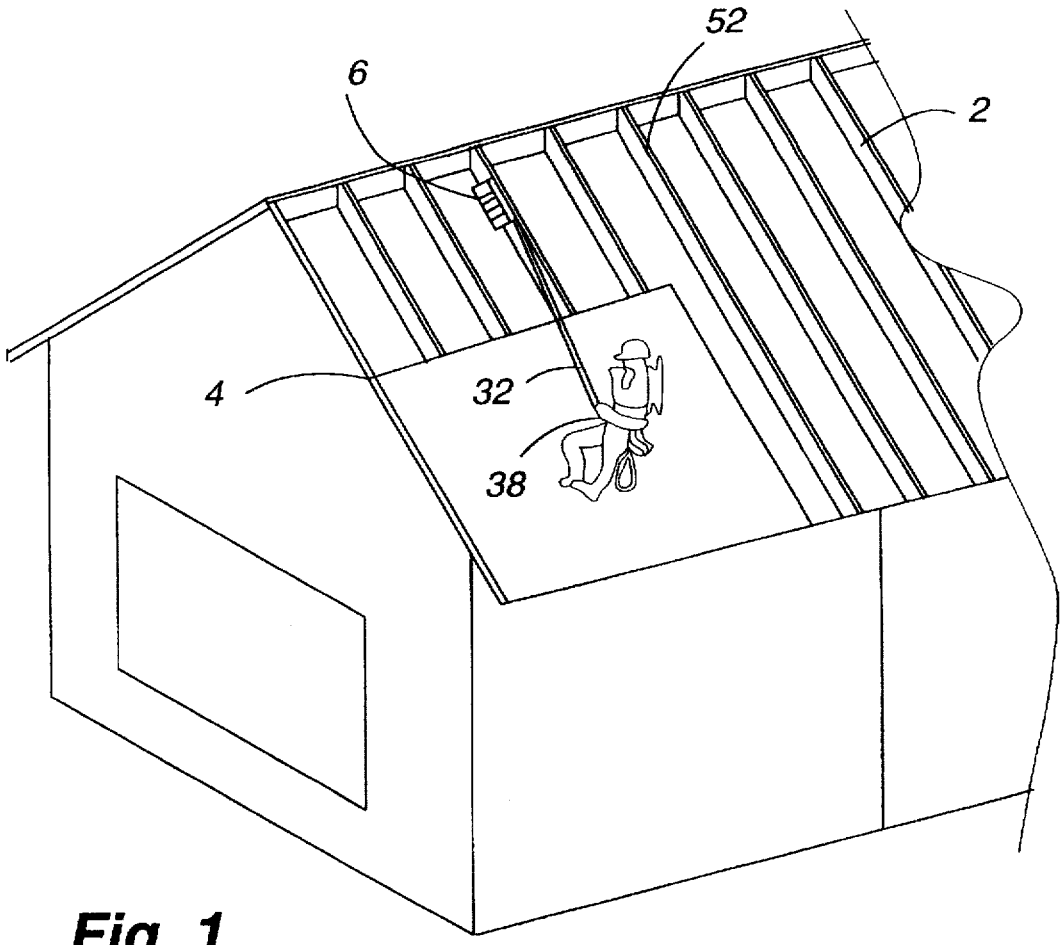
FIG. 1 is a perspective view of a construction worker attached to a retractable fall restraint device installed on the structure of a roof.

Referring now to the drawings, FIG. 1 is a perspective view of a construction worker using the fall restraint apparatus. As can be seen, the worker is wearing a safety harness 38 connected to a lifeline 32, which is attached to the slide plate 8 in an extended position to arrest a potential fall taken by the construction worker. Preferably, the lifeline 32 is attached to the safety harness 38 in a manner to allow the lifeline 32 to be easily lengthened or shortened depending on the desired activity of the user.

Figure 2:
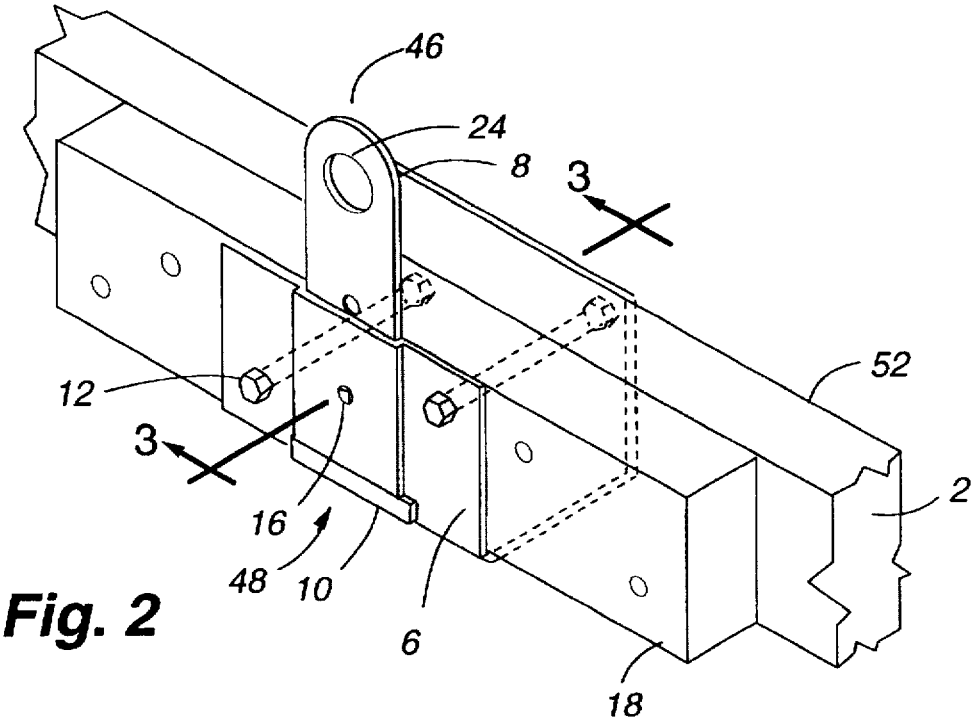
FIG. 2 is a perspective view of one of the embodiments of the invention shown attached to a roofing structural member.

FIG. 2 is a perspective view of the invention depicting the slide plate 8, the anchoring bracket 6, and components used for securement to a structural member 2 and spacing member 18. The slide plate 8 includes a first or upper end 46 and a second or lower end 48. The upper end 46 of the slide plate 8 incudes an attachment device (e.g., bore) for interconnecting the lifeline 32. Preferably, the attachment device is a bore 24 of sufficient internal diameter to allow the passage of the lifeline, hook, bracket, carabiner or other type of hardware which can be quickly connected and disconnected. As can be appreciated by one skilled in the art, any other type of attachment device may be substituted on the upper end 46 of the slide plate 8, including pins, bolts or cutout portions to allow attachment of the lifeline 32.

Figure 4:
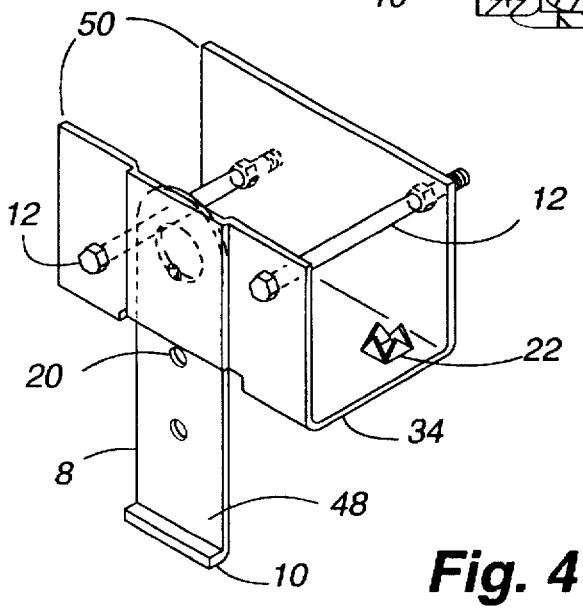
FIG. 4 is a perspective view of the embodiment of FIG. 2 showing the restraint mechanism in a retracted position.
Figure 5:
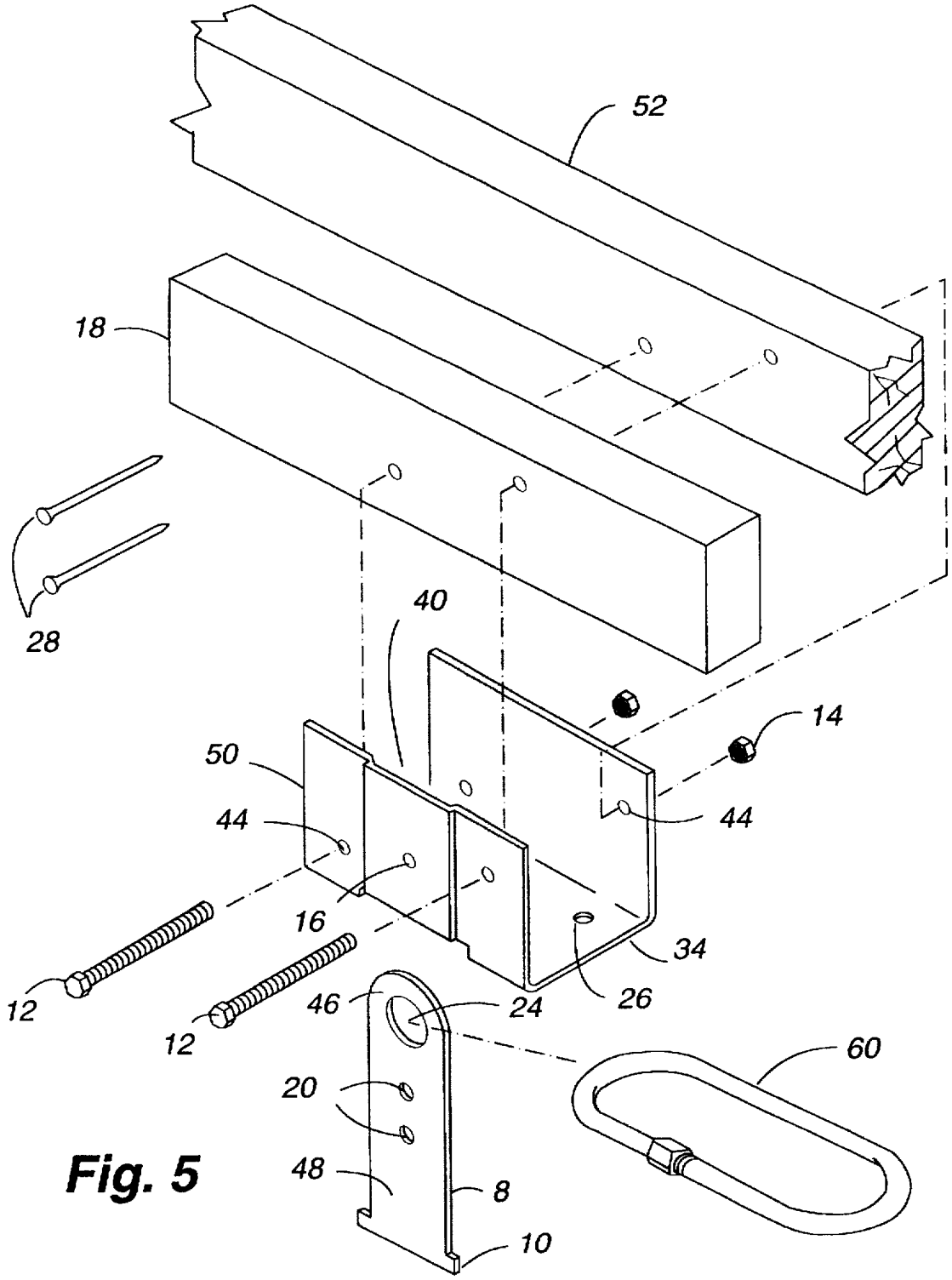
FIG. 5 is an exploded view of the embodiment of FIG. 2 including attachment hardware, structural support and spacing members.

The lower end 48 of the slide plate 8 preferably includes a mechanism for restricting upward travel of the slide plate 8. This prevents the slide plate 8 from extending beyond a specified length for safe use, or from becoming detached from the anchoring bracket 6 as a result of forces applied by the lifeline 32. More preferably, the mechanism for restricting upward travel includes a stop plate 10 which is interconnected to the lower end 48 of the slide plate 8 as shown in FIG. 4. An alternative configuration is seen in FIG. 5. During upward travel of the slide plate 8 to an extended position, the stop plate 10 is sized to engage the anchoring bracket 6 to prevent excessive travel. The stop plate 10 may further be a pin, lag bolt or other type of mechanism which engages the anchoring bracket 6 sufficiently.

Preferably, the slide plate 8 is made of a rigid material to prevent deflection and failure when force is applied to the lifeline 32 during a fall. Furthermore, the slide plate 8 can be constructed of a material of sufficient compressive strength to allow pounding by a hammer from either the upper end 46 when retracting the slide plate to a retracted position, or from the lower end 48 when moving the slide plate 8 to an extended position. Preferably, the slide plate 8 and interconnected stop plate 10 are made of steel or other metallic material, although plastics, fiberglass and other similar materials with sufficient strength to withstand the required forces can be utilized.

Figure 3:
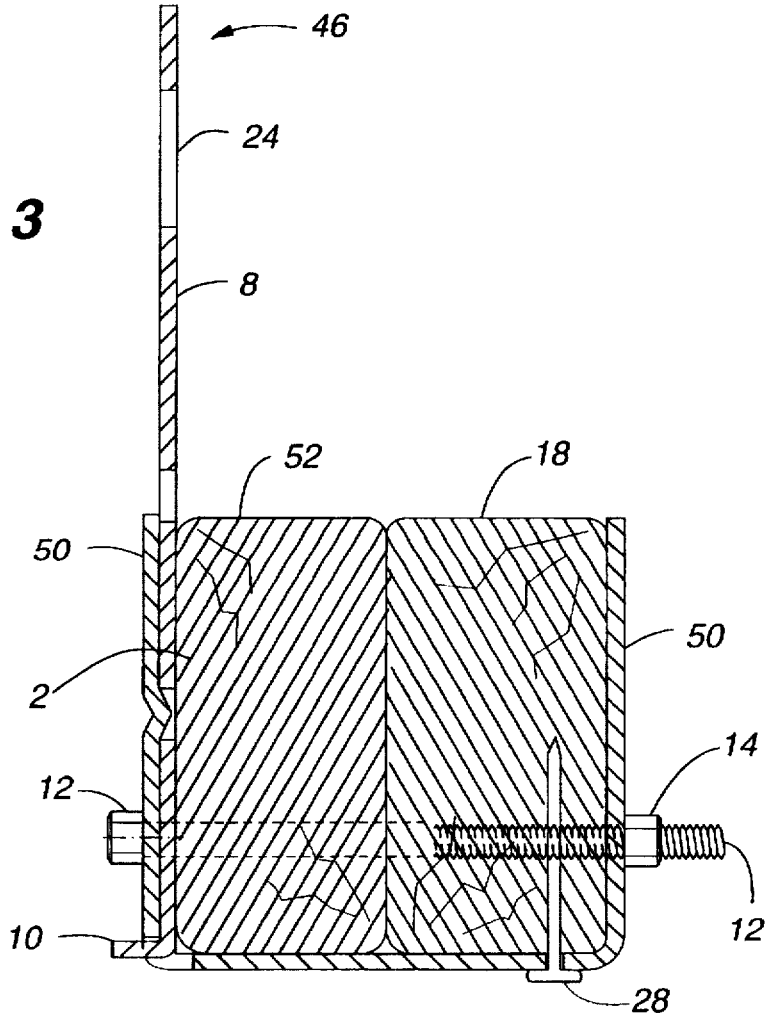
FIG. 3 is a cut-away end view of the embodiment of FIG. 2 taken along line 3—3 of FIG. 2.

The slide plate 8 is used in conjunction with an anchoring member 6 for securing the slide plate 8 to a structural support member 2 such as a roofing truss. The anchoring member 6 is preferably an anchoring bracket 6 which can easily and quickly be attached to the structural support member 2. Preferably, the anchoring bracket 6 is U-shaped and attached to the structural support member 2 by nail 28 or pin. As seen in FIG. 3 and FIG. 5, more preferably, the U-shaped anchoring bracket 6 is attached by a pair of bolts 12 and interconnecting nuts 14 to secure the U-shaped anchoring bracket 6 in a permanent, non-movable position around the structural member 2 and spacing member 18. Preferably, the bolts 12 attaching the U-shaped anchoring bracket 6 are offset with one bolt located near one corner of the U-shaped anchoring bracket and the other bolt near an opposing corner. It is further contemplated that the U-shaped anchoring bracket 6 can be frictionally engaged around the structural support member 2 without the use of any attachment hardware.

The U-shaped anchoring bracket 6 preferably includes two substantially parallel side walls 50 interconnected to a connecting plate 34 for support. The U-shaped anchoring bracket 6 further comprises a reciprocating area for allowing the slide plate 8 to be moved from a first extended position to a second retracted position. In the first extended position the upper end 46 of the slide plate 8 is exposed for use above a structural surface, such as the exterior surface of a roof 4. In the second retracted position, the upper end 46 of the slide plate 8 is in a non-visible position below the exterior surface of a structure such as a roof 4. Depending on the application and roofing materials used, the length of extension and retraction can be modified by changing the length of the slide plate 8. Generally, the slide plate has an extended position long enough to expose the bore 24 or other means for attachment of the lifeline just above the upper edge of a structural member 52. Similarly, when the slide plate 8 is retracted, the bore 24 of the slide plate 8 is lowered just below the upper edge of the structural member 52.

Figure 6:
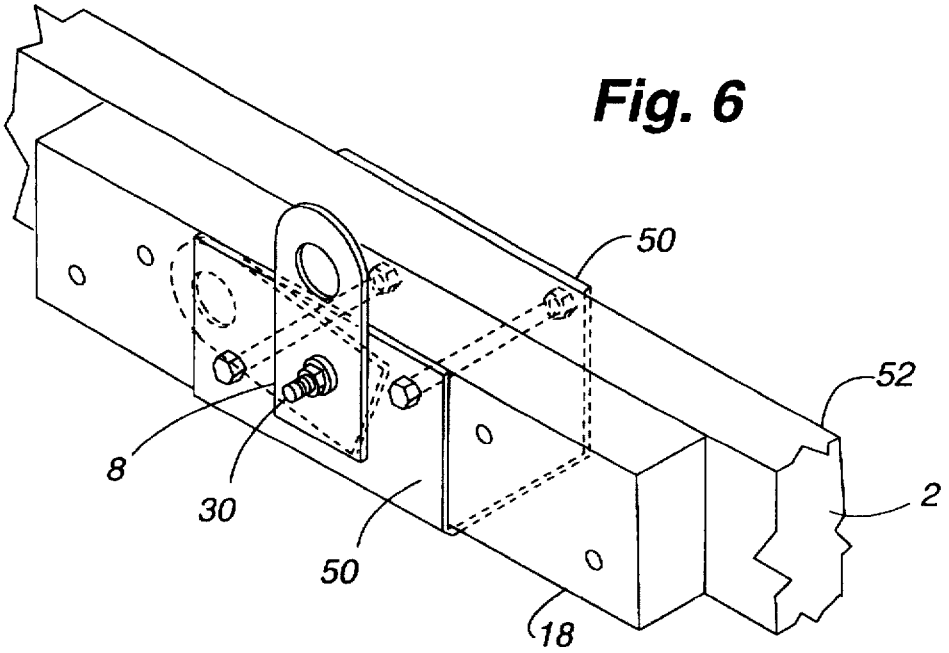
FIG. 6 is a perspective, partially phantom view of an alternative embodiment of the invention showing an arcuately retracting fall restraint mechanism.

As shown in FIG. 6, one particular embodiment for allowing reciprocation of the slide plate 8 is the use of a rotating pin 30 which is interconnected to at lease one side wall of the U-shaped anchoring bracket 6 and interconnected to the slide plate 8 to allow the slide plate 8 to rotate arcuately along an axis parallel to the side walls 50. The rotating pin 30 may be installed on either one side wall 50 or both depending on the necessity of having one or two slide plates 8 for attaching a lifeline 32 or a plurality of lifelines.

Figure 8:
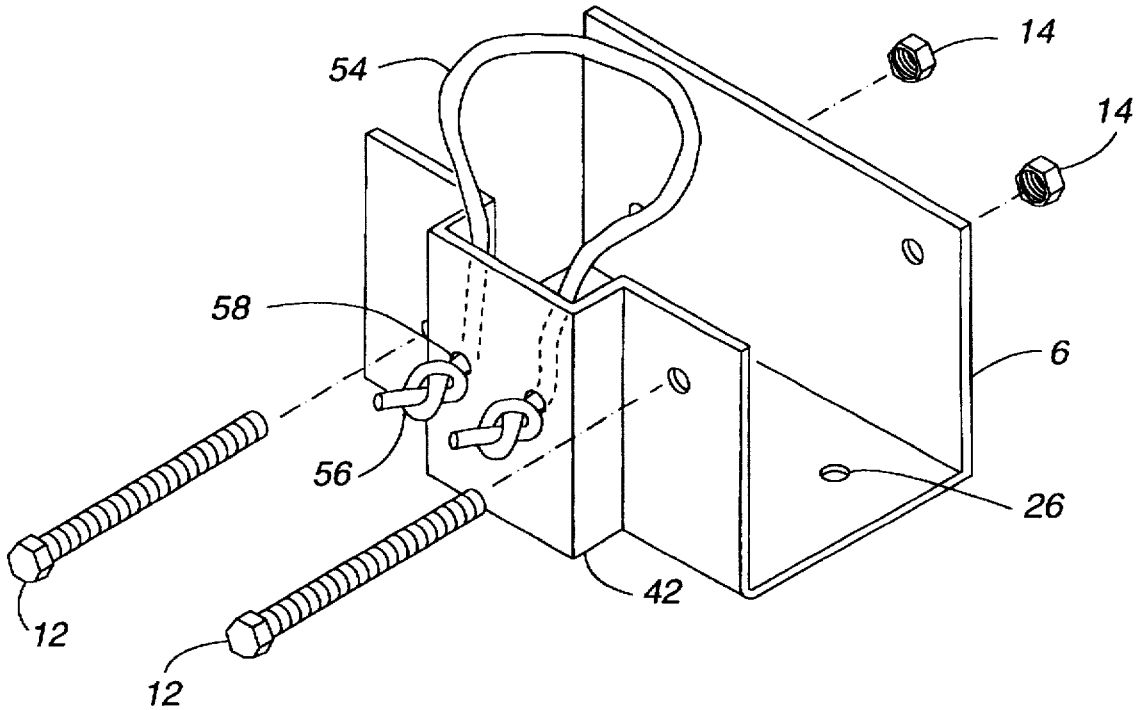
FIG. 8 is a perspective, partially phantom view of an alternative embodiment of the invention showing an attachment cable interconnected to the anchoring bracket.

As seen in FIG. 8, one alternative embodiment of the retractable fall restraint device is a restraint cable 54 interconnected to the U-shaped anchoring bracket 6. Preferably each end of the restraint cable 54 is fed inside the channel 40 of the U-shaped anchoring bracket 6 and extended outside the channel through a securement port 58. The securement port 55 may be located on a side-wall, exterior wall or the bottom of the channel 40. Preferably, the securement port is located a distance approximately half way between the top and bottom of the channel 40.

Figure 9:
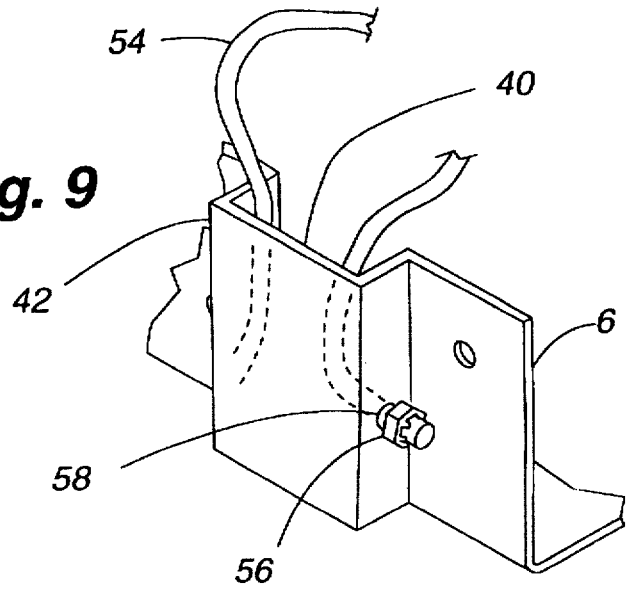
FIG. 9 is a perspective view of the embodiment of FIG. 8 with an alternative location of the securement port and restraint cable securement member.

To secure the restraint cable 54 to the U-shaped anchoring bracket 6, FIG. 8 shows knots tied in the ends of the restraint cable 54, which act as a restraint cable securement member 56. The knots have a diameter which prevents the ends of the restraint cable 54 from passing through the securement port 58. Other means such as attaching a bolt or nut to the ends of the restraint cable 54, or use of a bracket or welding to secure the ends of restraint cable 54 to the U-shaped restraint bracket 6 may be implemented. FIG. 9 shows the use of a nut attached as a restraint cable securement member 56 to prevent the cable 54 from being pulled through the securement port 58.

During use, the restraint cable 54 extends above the U-shaped anchoring bracket 6 a sufficient distance to allow the attachment of a lifeline 32. Once construction or other elevated activity is completed, the restraint cable 54 may be retracted from the surface of the roof by pulling the restraint cable 54 downward through the channel 40. Alternatively, the restraint cable 54 may be stored within the channel 40 if sized sufficiently. If it is not anticipated that the restraint cable will be used again, it may easily be cut off near the opening of the channel 40 and discarded.

As another embodiment of the present invention, one end of the restraint cable 54 may be attached to the U-shaped anchoring bracket 6 while the other end of the restraint cable 54 with an interconnected attachment loop is extended above the U-shaped anchoring bracket 6 for attachment of the lifeline 32. This type of configuration is favorable since a shorter amount of restraint cable 54 is required, thus a reduction of costs.

A preferred embodiment for reciprocating the slide plate 8 between a first extended position and a second retracted position is the use of a sleeve 42 interconnected to one or both side walls 50, which defines a channel 40. Preferably, the sleeve 42 is integrally formed during the fabrication of the U-shaped bracket for strength and reduced assembly costs. The channel 40, defined by the walls of the sleeve 42, should be of sufficient diameter to allow the slide plate 8 to slidingly move upward and downward when the U-shaped bracket is attached to a roof structural member 2 and spacing member 18. Thus, the slide plate 8 frictionally engages the interior wall of the sleeve on one side and the outer surface of the structural member 2 or spacing member 18 on the other side. Although the sleeve and slide bar described are generally rectangular in shape, round or other geometric configurations may additionally be used which are capable of being retracted.

Figure 7:
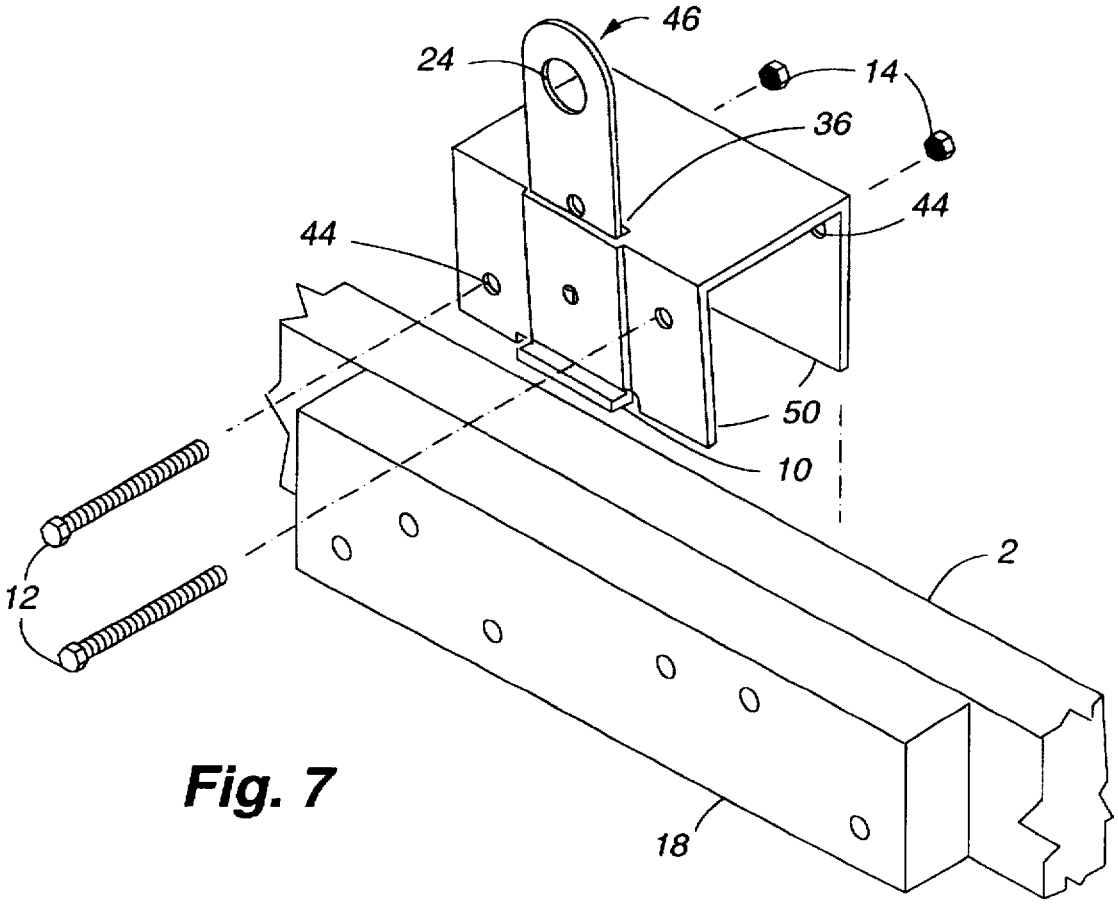
FIG. 7 is a perspective view of an alternative embodiment of the fall restraint device showing the anchoring bracket in an inverted position.

Additionally, the channel 40 defined by the sleeve 42 has a diameter large enough to accept the slide plate 8, yet small enough to engage the stop plate 10. Thus, the slide plate 8 can be extended upward to a first extended position only until the stop plate 10 engages the walls of the sleeve 42. As seen in FIG. 7, the connecting plate 34 additionally has a passage 36 to allow the slide plate 8 to reciprocate between a first extended position and a second retracted position.

In a preferred embodiment the sleeve 42 may have a dimple 16 protruding inward toward the opposing side wall. The dimple projects a distance which allows the slide plate 8 to travel within the sleeve 42, yet provides frictional resistance against the slide plate 8. The dimple 16 is designed to project into the engagement hole 20 in the slide plate 8. As the slide plate 8 slides within the channel 40 defined by the sleeve 42, the dimple projects into the engagement hole 20 and restricts travel of the slide plate 8. Alternatively, the dimple can be on the slide plate 8 and the hole can be in the sleeve 42.

To move the slide plate 8 from a first extended position to a second retracted position, the upper end 46 of the slide plate 8 is pushed downward, or struck with a hammer or other similar device. Likewise, to extend the slide plate 8 from a retracted position to an extended position, the lower end of the slide plate 48 is pushed upward, or struck with a hammer from within the attic space of the house or other structure.

To install the preferred embodiment of the retractable fall restraint device, a 2"×4" spacing member 18 or other suitable piece of scrap lumber, preferably at least about 18"–24" long, and more preferably 3'–5' long is attached to a roofing structural member 2 near the apex of the roof. The structural member 2 is preferably a roofing truss. The spacing member 18 and structural member 32 may be nailed, screwed, bolted or interconnected by other suitable means. The U-shaped bracket is then positioned around the structural member 2 and spacing member 18, preferably with the connecting plate 34 of the U-shaped anchoring bracket 6 on the bottom side of the structural support member 2. As an alternative embodiment shown in FIG. 7, the U-shaped bracket may be installed in an inverted position over the top of the structural member 2. However, this type of installation may leave a slight bulge on the exterior surface of the roof.

To assist in holding the U-shaped anchoring bracket 6 in a stable position prior to installing bolts or other attachment hardware, it is preferable that the connecting plate 34 have a securement hole 26 for receiving a nail, screw or other similar attachment device as seen in FIG. 3. More preferably, the connecting plate 34 may have a holding tab 22 which extends upward between the U-shaped side walls 50, as seen in FIG. 4. As the U-shaped anchoring bracket 6 is positioned around the structural member 2 and attached spacing member 18, the connecting plate 34 is struck with a hammer or other device to imbed the holding tab 22 into the structural truss 2 or attached spacing member 18, temporarily securing the U-shaped anchoring bracket 6.

Once the U-shaped anchoring bracket 6 is secured with a nail 28 or holding tab 22, at least one hole is drilled through the structural member 2 and attached to spacing member 18 and through the U-shaped bracket guide hole 44. A bolt 12 is then positioned through the guide hole 44, structural member 2 and attached spacing member 18 and through the companion guide hole 44, where a nut 14 is attached to the bolt 12. More preferably, a nylok type nut is used, as well as at least two bolts with minimum diameters of 5/16 of an inch.

Although it is preferable that the slide plate 8 be positioned within the channel 40 of at least one of the opposing side walls prior to installing the U-shaped anchoring bracket 6, it is possible to install the slide plate 8 after the U-shaped anchoring bracket 6 is bolted to the structural member 2 and spacing member 18.

When roofing or other construction operations are completed, the slide plate 8 is struck on the upper end 46 with a hammer, driving the slide plate 8 below the exterior surface of the roof 4. Silicon, tar paper, shingles and other similar materials are then used to cover the hole left by the slide plate 8 to prevent leaking. If at any time in the future the slide plate 8 is required to be extended outside of the roof surface for further use, the lower end 48 of the slide plate 8 is struck by a hammer or other device to extend the slide plate 8 upward through the roof surface. The lower end of the slide plate 48 is easily accessible by entering the attic of the house or other building.

For reference purposes, the following is a detailed list of the described components of the retractable roof restraint device, and corresponding numbers as shown in the drawings.

| Number | Component |
|---|---|
| 02 | roof truss structural member |
| 04 | exterior roof surface |
| 06 | anchoring bracket |
| 08 | slide plate |
| 10 | stop plate |
| 12 | bolts |

-continued

| Number | Component |
|---|---|
| 14 | nuts |
| 16 | dimple |
| 18 | spacing member |
| 20 | engagement holes |
| 22 | holding tab |
| 24 | bore |
| 26 | securement hole |
| 28 | nail |
| 30 | rotating pin |
| 32 | lifeline |
| 34 | connecting plate |
| 36 | passage |
| 38 | safety harness |
| 40 | channel |
| 42 | sleeve |
| 44 | bracket guide hole |
| 46 | slide plate upper end |
| 48 | slide plate lower end |
| 50 | side wall |
| 52 | structural member upper edge |
| 54 | restraint cable |
| 56 | restraint cable securement member |
| 58 | securement port |
| 60 | caribiner |

The foregoing description of the present invention has been presented for purposes of illustration and description. The description is not intended to limit the invention to the form disclosed herein. Consequently, the invention and modifications commensurate with the above teachings and skill and knowledge of the relevant art are within the scope of the present invention. The preferred embodiment described above is also intended to explain the best mode known of practicing the invention and to enable others skilled in the art to utilize the invention in various embodiments and with the various modifications required by their particular applications for use of the invention. It is intended that the appended claims be construed to include all alternative embodiments as permitted by the prior art.

What is claimed is:

1. A retractable fall restraint device for use with a structure, comprising:

a restraint means for supporting a lifeline;

an anchoring means cooperating with said restraint means for securing said restraint means to said structure, said anchoring means having reciprocating means to allow said restraint means to slidably move between a first extended position a second retracted position; wherein and said restraint means capable of being moved between said first extended position and the second retracted position, wherein when said restraint means is in said first extended position an attachment means is adapted to be exposed above an upper edge of said structure, and when said attachment means is in said second retracted position said attachment means is adapted to be positioned below said upper edge of said structure.

2. The retractable restraint device of claim 1, wherein said reciprocating means comprises at least one sleeve at least partially associated with said anchoring means for slidingly receiving said restraint means in order to permit movement between said first extended position and said second retracted position.

3. The retractable restraint device of claim 1, wherein said reciprocating means comprises a pin interconnected to said anchoring means and pivotally engaging said restraint means, wherein said restraint means arcuately travels between said first extended position and said second retracted position.

4. The retractable restraint device of claim 1, wherein said retractable restraint device is capable of withstanding at least 5000 lbs. of force applied to said restraint means.

5. The retractable restraint device of claim 1, further comprising at least one bolt and a companion nut to secure said anchoring means to said structure.

6. The retractable restraint device of claim 1, wherein said restraint means comprises a cable.

7. A retractable fall restraint device comprising:

at least one slide plate having a first end and a second end, said first end having attachment means and said second end having a means for restricting upward travel of said slide plate;

a U-shaped bracket having two substantially parallel side walls interconnected to a connecting plate, at least one of said side walls having reciprocating means for allowing said slide plate to move between a first extended position and a second retracted position; and means for attaching said U-shaped bracket to a structural member, wherein when said slide plate is in said second retracted position said attachment means of said slide plate is adapted to be positioned below a top surface of said structural member.

8. The retractable fall restraint device of claim 7, wherein said connecting plate further comprises a securement hole for receiving a nail to secure said U-shaped bracket to said structural member.

9. The retractable fall restraint device of claim 7, wherein said connecting plate further comprises a holding tab extending upward between said two substantially parallel side walls to temporarily attach said U-shaped bracket to said structural member.

10. The retractable fall restraint device of claim 7, wherein said means for attaching said U-shaped bracket comprises at least one bolt capable of interconnecting said U-shaped bracket to a spacing member positioned adjacent said structural member.

11. The retractable fall restraint device of claim 7, wherein said attachment means comprises a bore of sufficient diameter to connect a lifeline.

12. The fall restraint device of claim 7, wherein said slide plate may be reciprocated from said second retracted position to said first extended position by applying force to said second end of said slide plate.

13. The fall restraint device of claim 7, wherein said reciprocating means comprises at least one sleeve interconnectable to said side wall, said sleeve having a channel for slidingly receiving said slide plate wherein said slide plate may travel between said first extended position and said second retracted position.

14. The fall restraint device of claim 13, wherein:

said sleeve further comprises a dimple projecting inwardly towards said opposing side wall; and said slide plate further comprises at least one engaging hole sized to receive said dimple, wherein when said dimple projects into said engaging hole, said slide plate is secured in a predetermined position.

15. A retractable fall restraint device adapted for use in combination with a roof having a plurality of structural truss members, comprising:

a slide plate having a first end and a second end, said first end having a cutout portion for attaching a lifeline and said second end having a stop plate extending in a substantially perpendicular direction from the longitudinal axis of said slide plate;

a U-shaped bracket adapted for attachment to said structural truss members, said U-shaped bracket having two substantially parallel side walls and a connecting plate, at least one of said side walls having a channel for slidingly receiving said slide plate;

a passage located adjacent to said channel in said connecting plate, said passage having a diameter large enough to receive said slide plate yet small enough to engage said stop plate, wherein when said retractable fall restraint device is attached to one of said structural truss members said slide plate may be reciprocated between a first extended position with the first end of said slide plate positionable above an upper edge of said structural truss member of said roof and a second retracted position wherein the first end of said slide plate is postionable below the upper edge of said structural truss member of said roof.

16. A method for using a retractable fall restraint device adapted for use in combination with a roof having structural members and an exterior surface comprising the steps of:

a) positioning an anchoring means and interconnected restraint means on said structural member of said roof;

b) securing said anchoring means to said structural member to immobilize said anchoring means;

c) slidably extending said restraint means to expose an attachment means above said structural members of said roof;

d) attaching one end of a lifeline to said attachment means and a second end of said lifeline to an object;

e) detaching said lifeline from said object and said attachment means; and f) slidably retracting said restraint means to position said attachment means below said structural members of said roof, wherein when said restraint means is retracted said attachment means is not visible above said exterior surface of said roof.

17. The method of claim 16, wherein the step of retracting said restraint means comprises applying force to said restraint means to arcuately rotate said restraint means between a first extended position and second retracted position.

18. The method of claim 16, wherein the step of retracting said restraint means comprises applying force to one end of said restraint means to slide said restraint means in a channel defined by said anchoring means and one of said structural members.

19. The method of claim 16, wherein said step of attaching one end of a lifeline to said attachment means comprises interconnecting a carabiner to said attachment means.

20. A method for installing a retractable fall restraint apparatus adapted for use in combination with a roof, said roof comprising a plurality of structural members, an exterior surface, and an apex, comprising the steps of:

a) interconnecting a retractable restraint means to an anchoring means;

b) attaching a spacing member to said structural member of said roof; and c) securing said anchoring means to said structural member and said spacing member near the apex of said roof, wherein said restraint member is operatively positioned to slidably travel between a first extended position above the exterior surface of said roof and a second retracted position below said exterior position of said roof.

* * * * *